US008596209B2

(12) United States Patent
Fujihara et al.

(10) Patent No.: US 8,596,209 B2
(45) Date of Patent: Dec. 3, 2013

(54) MULTI-NEEDLE SEWING MACHINE

(75) Inventors: Shinya Fujihara, Ichinomiya (JP); Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 947 days.

(21) Appl. No.: 12/659,226

(22) Filed: Mar. 1, 2010

(65) Prior Publication Data

US 2010/0236463 A1 Sep. 23, 2010

(30) Foreign Application Priority Data

Mar. 20, 2009 (JP) ..... 2009-069185

(51) Int. Cl.
*D05B 19/00* (2006.01)

(52) U.S. Cl.
USPC ..... 112/470.05

(58) Field of Classification Search
USPC ..... 112/470.01, 470.05, 470.06, 102.5, 112/222, 475.01, 475.18, 475.19
See application file for complete search history.

(56) References Cited

U.S. PATENT DOCUMENTS

| | | | | |
|---|---|---|---|---|
| 4,784,071 | A | 11/1988 | Sadeh et al. | |
| 4,798,152 | A | 1/1989 | Simons et al. | |
| 4,998,489 | A | 3/1991 | Hisatake et al. | |
| 5,027,726 | A | 7/1991 | Brower et al. | |
| 5,323,722 | A | 6/1994 | Goto et al. | |
| 5,911,182 | A | 6/1999 | Uyama et al. | |
| 6,263,815 | B1 | 7/2001 | Furudate | |
| 7,325,502 | B2 * | 2/2008 | Konig et al. | 112/475.02 |
| 8,196,535 | B2 * | 6/2012 | Tokura | 112/470.01 |
| 2002/0157588 | A1 | 10/2002 | Musco et al. | |
| 2007/0227420 | A1 | 10/2007 | Suzuki et al. | |

FOREIGN PATENT DOCUMENTS

| | | |
|---|---|---|
| JP | A-02-057288 | 2/1990 |
| JP | A-04-364884 | 12/1992 |
| JP | A 5-68760 | 3/1993 |
| JP | Y2-07-001114 | 1/1995 |
| JP | A-8-24464 | 1/1996 |
| JP | A 8-71287 | 3/1996 |
| JP | Y2-2503528 | 7/1996 |
| JP | A-09-250068 | 9/1997 |
| JP | A-11-172566 | 6/1999 |
| JP | A-2000-235212 | 8/2000 |
| JP | U-3100627 | 5/2004 |
| JP | A-2005-177777 | 7/2005 |
| JP | A-2006-012203 | 1/2006 |
| JP | A-2006-169696 | 6/2006 |
| JP | A-2007-289653 | 11/2007 |

* cited by examiner

*Primary Examiner* — Tejash Patel
(74) *Attorney, Agent, or Firm* — Oliff & Berridge, PLC

(57) ABSTRACT

A multi-needle sewing machine includes a plurality of needle bars to each bottom end of which a needle can be attached, a needle bar case in which the plurality of needle bars are disposed in a line and that supports the plurality of the needle bars movably in an up-and-down direction, a needle bar case moving device that, by moving the needle bar case, moves one of the plurality of the needle bars to an image capture position, the image capture position being a position that is located directly above a needle drop position that is a sewing position, and an image capture device that is provided in a position that is lined up with the plurality of the needle bars, that is positioned in the image capture position by the needle bar case moving device's moving of the needle bar case, and that captures an image.

3 Claims, 15 Drawing Sheets

MULTI-NEEDLE SEWING MACHINE

CROSS-REFERENCE TO RELATED APPLICATION

This application claims priority to Japanese Patent Application No. 2009-069185, filed Mar. 20, 2009, the content of which is hereby incorporated herein by reference in its entirety.

BACKGROUND

The present disclosure relates to a multi-needle sewing machine that has a plurality of needle bars. More specifically, the present disclosure relates to a multi-needle sewing machine that is provided with an image capture device that captures an image.

A sewing machine is known that is provided with an image capture device that captures an image. For example, a sewing machine is known that uses an image capture device to capture an image of and detect a pattern on a work cloth, then moves the work cloth based on the detection result. A sewing machine is also known that uses an image capture device to capture an image of an area that includes a needle drop position of a needle and displays the image on a display device. By looking at the displayed image on the display device a user may easily check the needle position and the state of the sewing without putting his/her face close to the needle drop position. Various effects may thus be obtained by mounting the image capture device on a sewing machine.

SUMMARY

In the known sewing machine, a needle bar is disposed straight overhead in relation to the needle drop position, so the image capture device must be disposed obliquely overhead in relation to the needle drop position. Therefore, an image may not be captured from a position that is straight overhead in relation to the needle drop position.

In order to capture an image of the work cloth, if the characteristics of the image capture device, such as image distortion and the like, are taken into consideration, it is desirable for the image capture device to be disposed straight overhead, and not obliquely overhead, in relation to the position on the horizontally disposed work cloth of which the image will be captured. Further, in a case where an image will be captured of an area that includes a needle drop position, it is desirable for the image capture device to be disposed straight above the needle drop position.

Various exemplary embodiments of the broad principles derived herein provide a multi-needle sewing machine that can capture an image of the needle drop position of a needle from a position that is straight overhead in relation to the needle drop position.

Exemplary embodiments provide a multi-needle sewing machine. The multi-needle sewing machine includes a plurality of needle bars to each bottom end of which a needle can be attached, and a needle bar case in which the plurality of needle bars are disposed in a line and that supports the plurality of the needle bars movably in an up-and-down direction. The multi-needle sewing machine also includes a needle bar case moving device that, by moving the needle bar case, moves one of the plurality of the needle bars to an image capture position. The image capture position is a position that is located directly above a needle drop position that is a sewing position. The multi-needle sewing machine further includes an image capture device that is provided in a position that is lined up with the plurality of the needle bars in the needle bar case, that is positioned in the image capture position by the needle bar case moving device's moving of the needle bar case, and that captures an image.

BRIEF DESCRIPTION OF THE DRAWINGS

Exemplary embodiments will be described below in detail with reference to the accompanying drawings in which.

DETAILED DESCRIPTION

Hereinafter, a multi-needle sewing machine 1 that is an embodiment will be explained with reference to the drawings. The referenced drawings are used for explaining technical features that may be utilized in the present disclosure, and the device configurations and the like that are described are simply explanatory examples that do not limit the present disclosure to only those configurations and the like.

Figure 1:
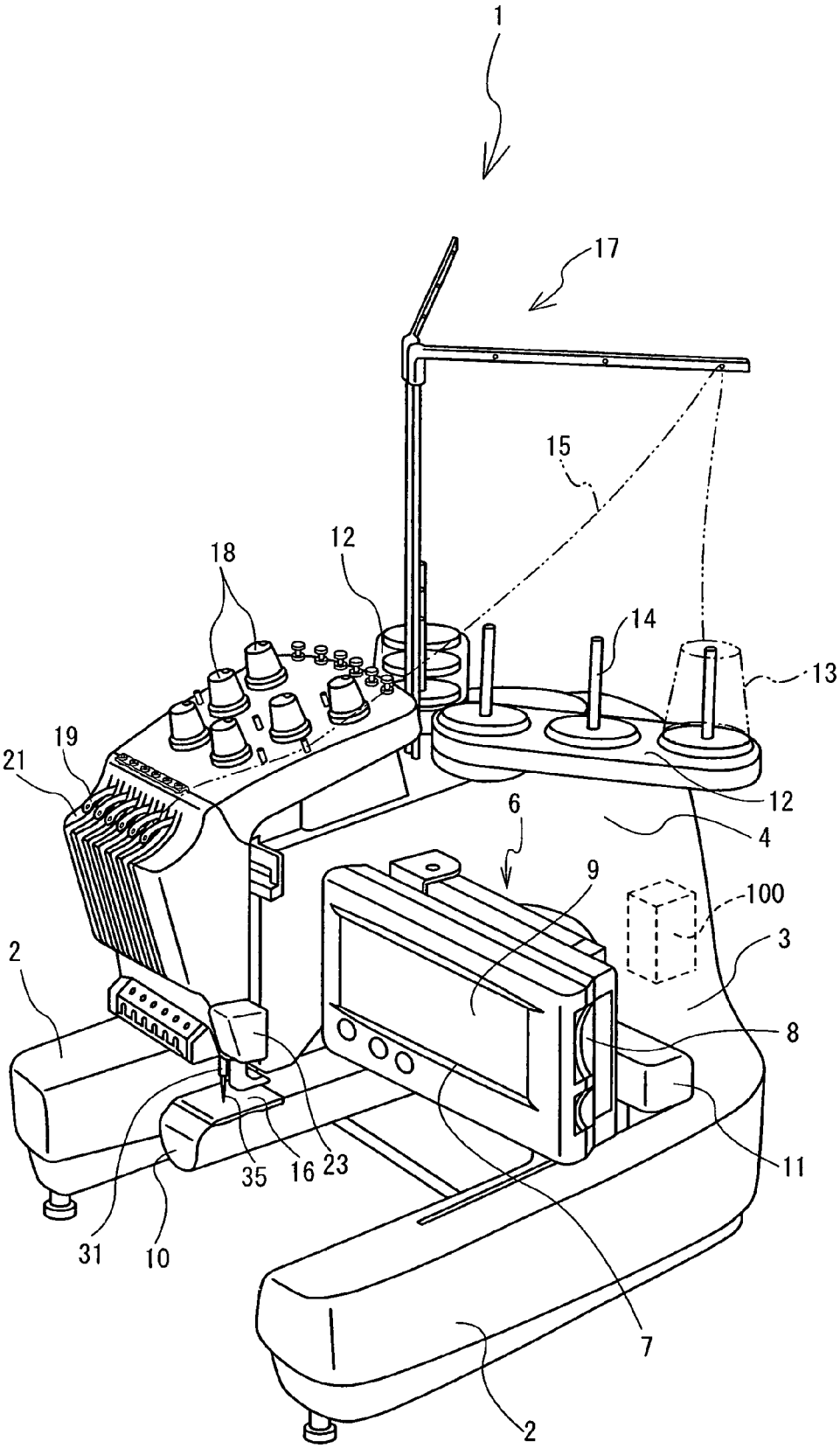
FIG. 1 is an oblique view of a multi-needle sewing machine.

A physical configuration of the multi-needle sewing machine 1 will be explained with reference to FIG. 1. In the explanation that follows, in FIG. 1, the lower left side, the upper right side, the upper left side, and the lower right side of the page respectively indicate the front side, the rear side, the left side, and the right side of the multi-needle sewing machine 1.

The multi-needle sewing machine 1 is provided with a supporting portion 2, a pillar 3, and an arm 4. The supporting portion 2 is formed in an inverted U shape in a plan view, and the supporting portion 2 supports the entire multi-needle sewing machine 1. The pillar 3 extends upward from the supporting portion 2. The arm 4 extends forward from the upper end of the pillar 3. A needle bar case 21 that is movable to the right and to the left is mounted on the front end of the arm 4. As will be described in detail below, six needle bars 31 and an image sensor 52 (refer to FIG. 2) are provided in the needle bar case 21 such that the needle bars 31 and the image sensor 52 are lined up in the right-to-left direction. By moving the needle bar case 21 to the right and to the left, the multi-needle sewing machine 1 moves one of the image sensor 52 and the six needle bars 31 to a position that is straight overhead in relation to a needle drop position. The needle drop position is a point at which a needle 35 is moved downward and pierces a work cloth (not shown in the drawings).

An operation portion 6 is provided on the right side of the arm 4 at a central position in the front-to-rear direction. A vertically extending shaft serves as an axis of rotation on which the operation portion 6 is pivotally supported by the arm 4. The operation portion 6 is provided with a liquid crystal display 7, a memory card connector 8, a touch panel 9, and the like. An operation screen, a captured image (refer to FIG. 15, for example), and the like are displayed on the liquid crystal display 7. The operation screen is used by a user to input a command. The captured image is an image that has been captured by the image sensor 52. A memory card 160 may be inserted into the memory card connector 8. The touch panel 9 may be used for accepting a command from the user.

A cylindrical cylinder bed 10 that extends forward from the bottom end of the pillar 3 is provided underneath the arm 4. A shuttle (not shown in the drawings) is provided in the interior of the front end of the cylinder bed 10. A bobbin (not shown in the drawings) on which a lower thread is wound may be accommodated in the shuttle. A shuttle drive mechanism (not shown in the drawings) is also provided in the interior of the cylinder bed 10. The shuttle drive mechanism rotationally drives the shuttle. A needle plate 16 is provided on a top face of the cylinder bed 10. A needle hole 97 (refer to FIG. 15) into which the needle 35 is inserted is provided in the needle plate 16.

A carriage 11 of an embroidery frame moving mechanism is provided underneath the arm 4. The embroidery frame moving mechanism moves an embroidery frame (not shown in the drawings) forward and rear, and right and left. During embroidery sewing, the embroidery frame, to which the work cloth is attached, is set on the carriage 11. The multi-needle sewing machine 1 performs embroidery sewing while using an X-axis motor 132 and a Y-axis motor 134 of the embroidery frame moving mechanism to move the embroidery frame forward and rear, and right and left.

A right-left pair of spool platforms 12 are provided at the rear face side of the top face of the arm 4. Spool pins 14 that may support spools 13 are provided on the spool platforms 12. Each of the spool platforms 12 may support a maximum of three spools 13. In other words, six of the spools 13, the same as the number of the needle bars 31, may be set on the pair of the spool platforms 12. An upper thread 15 that extends from one of the spools 13 that are supported by the spool platforms 12 may pass through a thread guide 17, a thread tension adjuster 18, a thread take-up lever 19, and the like, and may be supplied to an eye (not shown in the drawings) of one of the needles 35 that is mounted on the bottom edge of one of the needle bars 31.

A drive shaft (not shown in the drawings) extends in the front-to-rear direction in the interior of the arm 4. The drive shaft is rotated by a sewing machine motor 122 A needle bar drive mechanism (not shown in the drawings) for moving one of the six needle bars 31 up and down is provided on the front end of the drive shaft. The needle bar drive mechanism converts the rotational movement of the drive shaft into a cranking movement of a crank lever (not shown in the drawings) that moves a movable body (not shown in the drawings) reciprocally up and down. The movable body engages an engaging pin (not shown in the drawings) for one of the needle bars 31 that is centrally located in the right-to-left direction of the multi-needle sewing machine 1, so that the movable body may move the one of the needle bars 31 up and down. The shuttle drive mechanism in the interior of the cylinder bed 10 is driven in conjunction with the rotation of the drive shaft. When the drive shaft rotates, the one of the needle bars 31, the corresponding thread take-up lever 19, and the shuttle are driven in a synchronized manner, and a stitch may be formed in the work cloth.

Figure 2:
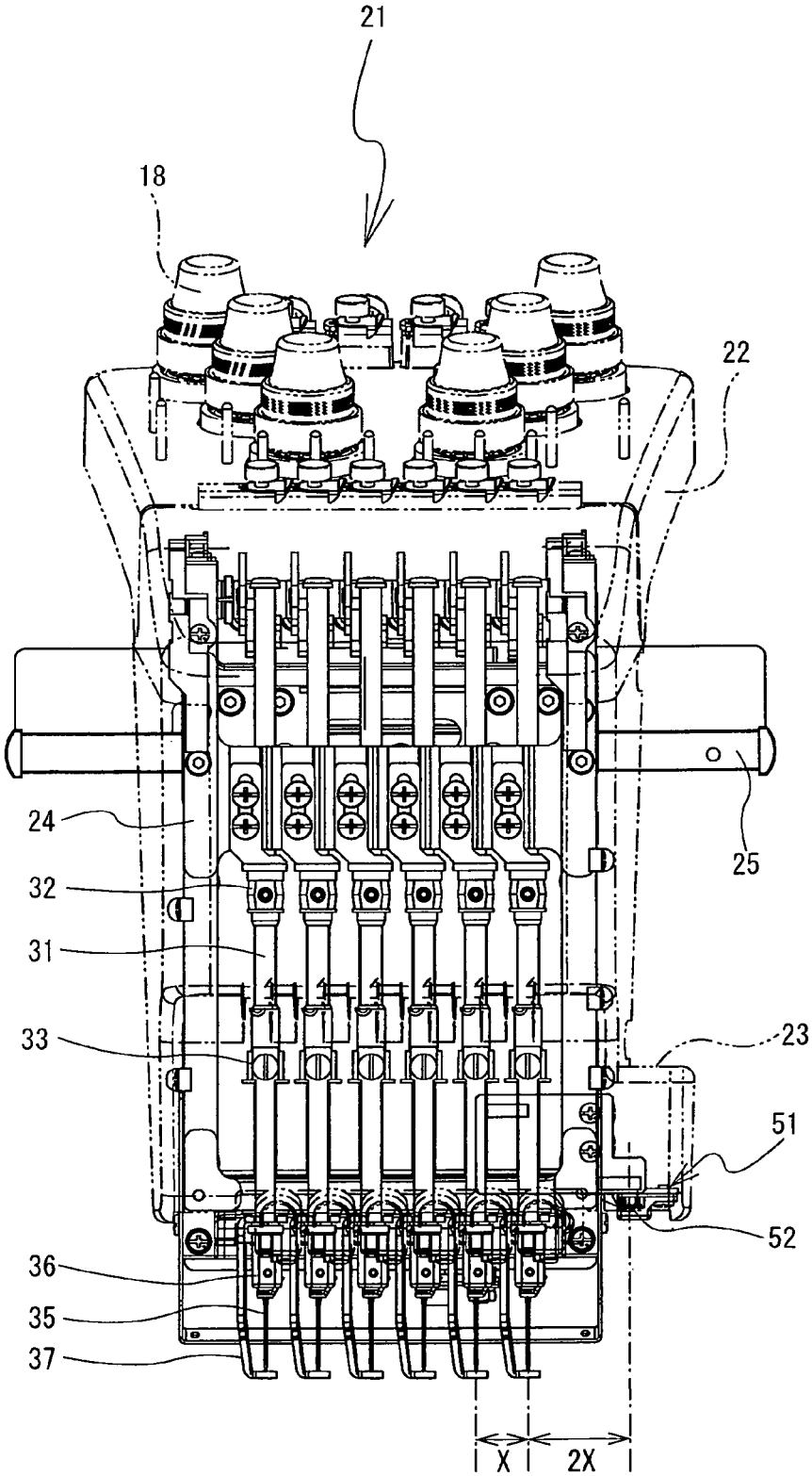
FIG. 2 is a front view that shows an interior of a needle bar case.
Figure 3:
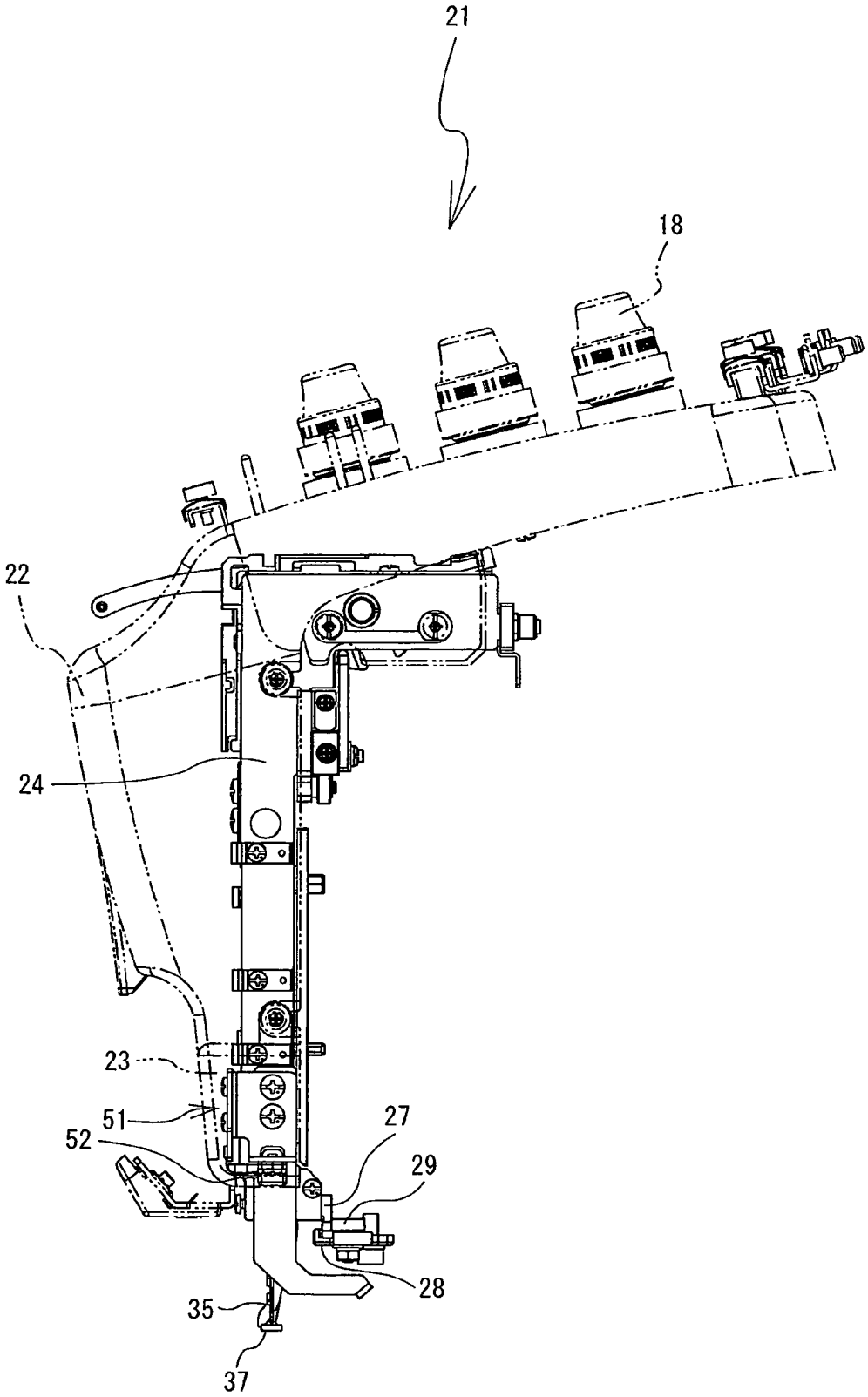
FIG. 3 is a right side view that shows the interior of the needle bar case.

As shown in FIGS. 2 and 3, a frame 24 is provided in the interior of a cover of the needle bar case 21. The frame 24 is rectangular when viewed from the front and has an inverted L shape when viewed from the right side. As shown in FIG. 2, a slide rail 25 that extends in the right-to-left direction is fixed to the front end portion of the arm 4 (refer to FIG. 1). The frame 24 is provided with a guide block (not shown in the drawings) slightly above the center point of the up-down direction. The guide block slides along the slide rail 25. As shown in FIG. 3, a restricting member 27 is fixed to the lower part of the rear face of the frame 24. The restricting member 27 restricts the movement of the frame 24 in the front-to-rear direction at the lower part. A claw 28 and a plurality of rollers 29 are provided at the lower part of the front edge of the arm 4. The claw 28 engages the restricting member 27 on the frame 24. The plurality of the rollers 29 are in contact with the rear face of the restricting member 27. This configuration allows the frame 24 to move smoothly to the right and to the left in relation to the arm 4 while being guided by the slide rail 25.

As shown in FIG. 2, the six needle bars 31 are lined up in the right-to-left direction inside the frame 24. Central axis lines (not shown in the drawings) of the six needle bars 31 are each oriented in the vertical direction and are located such that the central axis lines are parallel to one another in a single plane. In other words, in a plan view, the center positions (the center points) of the six needle bars 31 are located on a single straight line. A number from one to six is assigned to each of the six needle bars 31, starting from the right. The intervals between the central axis lines of the needle bars 31 are set such that the intervals are all equal. Hereinafter, the intervals between the central axis lines of the needle bars 31 are defined as intervals X between the needle bars 31. Coil springs (not shown in the drawings) are mounted on the outsides of the needle bars 31, and the needle bars 31 are urged upward by the urging force of the coil springs. The needle bars 31 are provided with needle bar holders 32 in the center of the up-down direction and are provided with presser holders 33 slightly below the center of the up-down direction. In addition, needle holders 36 may each be fixed to the lower parts of the needle bars 31. The needles 35 may each be fixed to the needle holders 36. At this time, central axis lines (not shown in the drawings) of the needles 35 are aligned with the central axis lines of the needle bars 31. Accordingly, the intervals between the central axis lines of the needles 35 are equal to the intervals between the central axis lines of the needle bars 31. Presser feet 37 are formed such that the presser feet extend from the presser holders 33 to slightly below the lower ends (the tips) of the needles 35. One of the presser feet 37 may move in conjunction with the up and down movement of one of the needles 35 and intermittently press the work cloth downward.

As shown in FIGS. 2 and 3, an image sensor holding mechanism 51 is provided at the lower part of the right side face of the frame 24. The image sensor holding mechanism 51 is covered by a sensor protective portion 23 of the cover 22. The image sensor holding mechanism 51 holds the image sensor 52 such that the image sensor 52 may capture an image of the area below the image sensor 52. As will be described in detail below, it is possible to use the image sensor holding mechanism 51 to perform fine adjustment of the mounting angle of the image sensor 52.

As shown in FIG. 3, the image sensor 52 that is held by the image sensor holding mechanism 51 is provided such that the image sensor 52 is aligned with the six needle bars 31. That is, in a plan view, the center position of the image sensor 52 is located on a straight line that passes through the center positions (the center points) of the six needle bars 31. As shown in FIG. 2, the distance between the central axis line of the number one needle bar 31 and the center axis line in the vertical direction that passes through the center point of a lens of the image sensor 52 (refer to FIG. 14) is 2X, which is an integral multiple of the interval X between the needle bars 31. The number one needle bar 31 is the needle bar 31 that is the farthest to the right of the six needle bars 31. The six needle bars 31 and the image sensor 52 are moved to the right and to the left by moving the needle bar case 21 to the right and to the left. Accordingly, the central axis line of one of the image sensor 52 and the needle bars 31 may be positioned straight overhead in relation to the needle drop position, which is the sewing position.

Figure 4:
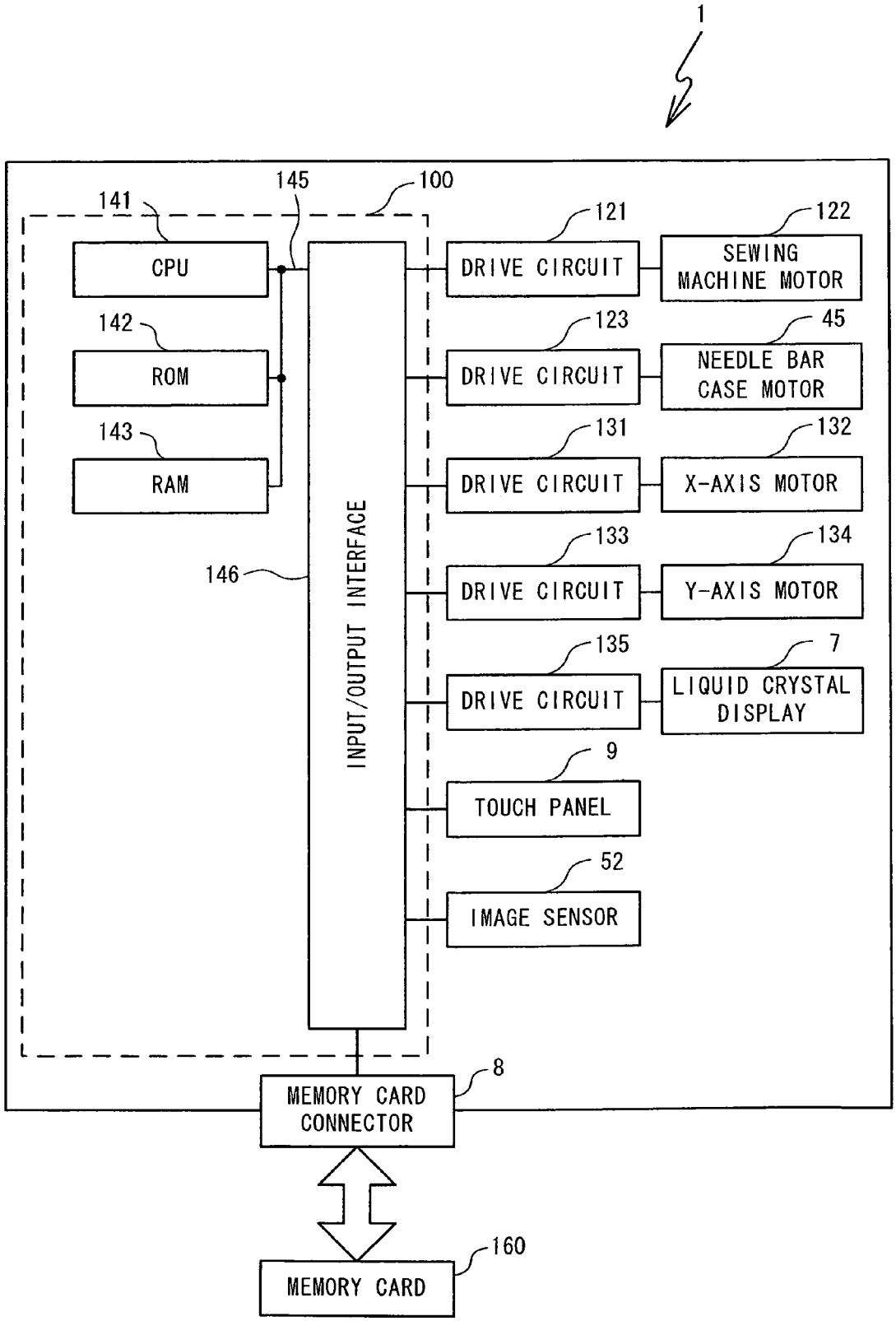
FIG. 4 is a schematic diagram that shows an electrical configuration of the multi-needle sewing machine.

An electrical configuration of the multi-needle sewing machine 1 will be explained with reference to FIG. 4. As shown in FIG. 4, a control portion 100 of the multi-needle sewing machine 1 includes a CPU 141, a ROM 142, a RAM 143, and an input/output interface 146, which are connected to one another via a bus 145. The CPU 141 conducts main control over the multi-needle sewing machine 1 and executes various types of computation and processing in accordance with a control program, which is stored in the ROM 142. The ROM 142 is a read-only storage element. The RAM 143 is a storage element that can be read from and written to as desired. The RAM 143 temporarily stores various types of data. The input/output interface 146 mediates exchanges of data. Drive circuits 121, 123, 131, 133, 135, the touch panel 9, the image sensor 52, and the memory card connector 8 are connected to the input/output interface 146. The drive circuit 121 drives the sewing machine motor 122. The drive circuit 123 drives a needle bar case motor 45. The drive circuits 131 and 133 respectively drive the X-axis motor 132 and the Y-axis motor 134. The drive circuit 135 drives the liquid crystal display 7. The memory card 160 may be inserted into the memory card connector 8.

Figure 5:
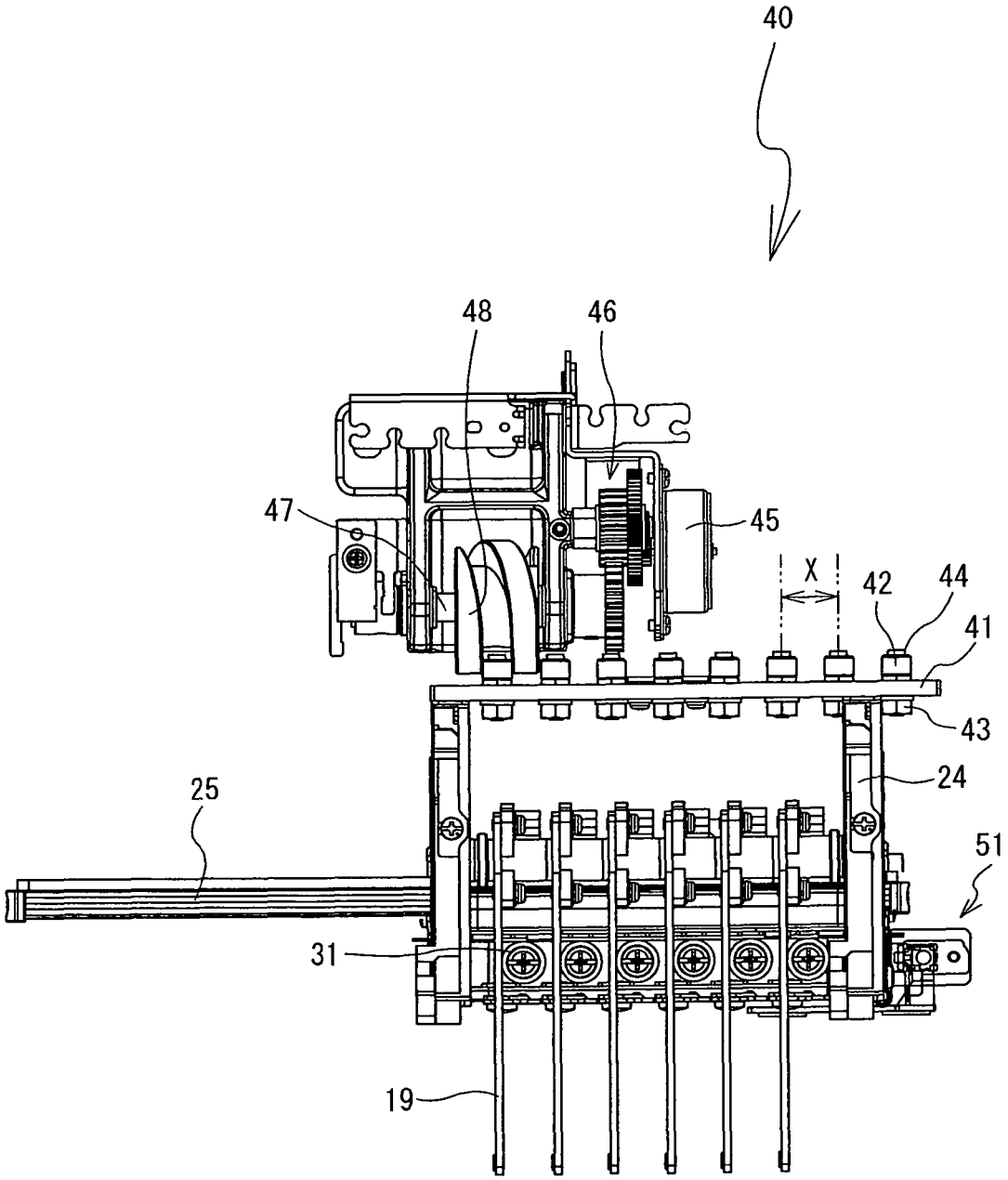
FIG. 5 is a plan view of a needle bar case moving mechanism in a state in which a frame of the needle bar case has been moved to a right end.
Figure 6:
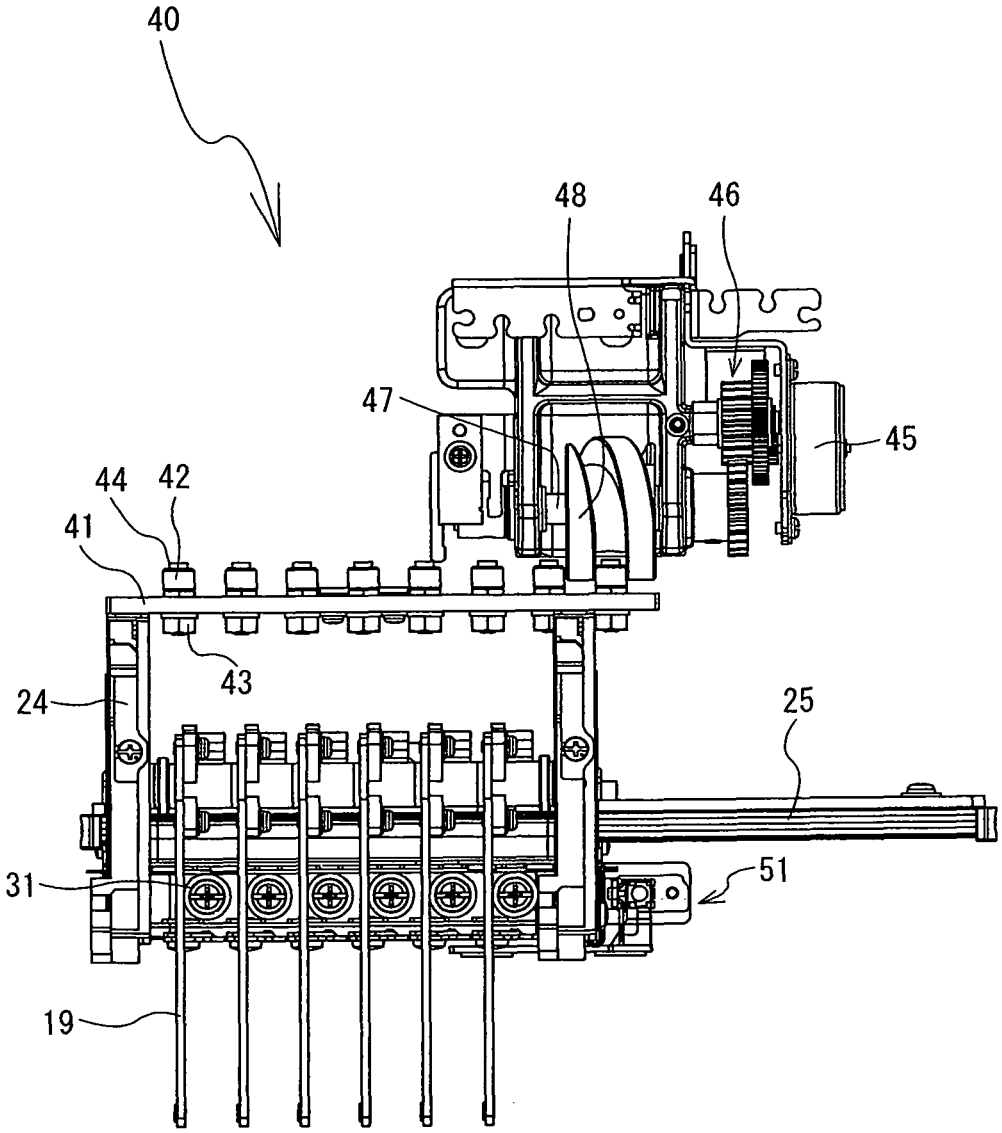
FIG. 6 is a plan view of the needle bar case moving mechanism in a state in which the frame of the needle bar case has been moved to a left end.

A needle bar case moving mechanism 40 that moves the needle bar case 21 will be explained with reference to FIGS. 5 and 6. In FIGS. 5 and 6, the lower sides, the upper sides, the left sides, and the right sides of the pages respectively indicate the front side, the rear side, the left side, and the right side of the multi-needle sewing machine 1.

As shown in FIGS. 5 and 6, a roller mounting plate 41, which extends in the right-to-left direction, is affixed to the rear edge of the upper portion of the frame 24. Eight engaging rollers 42 are revolvably mounted in the roller mounting plate 41 from the rear side. Each of the engaging rollers 42 has a round cylindrical shape that is not shown in detail in the drawings. The engaging rollers 42 are supported by shoulder bolts 44 such that the engaging rollers 42 may revolve and such that the engaging rollers 42 cannot move in the axial direction. The shoulder bolts 44 are threaded into threaded holes (not shown in the drawings) in the roller mounting plate 41 and secured. The tips of male threaded portions of the shoulder bolts 44 are secured by nuts 43 such that the shoulder bolts 44 will not be loosened by the revolving of the engaging rollers 42. The intervals between the central axis lines of the engaging rollers 42 are all the same as the intervals X between the needle bars 31.

The needle bar case motor 45 is provided on the arm 4 (refer to FIG. 1) to the rear of the roller mounting plate 41. The needle bar case motor 45 is a pulse motor. The needle bar case motor 45 is affixed such that the axial direction of an output shaft of the needle bar case motor 45 is oriented in the right-to-left direction. In the interior of the arm 4, a rotating shaft 47 is pivotally supported such that the rotating shaft 47 is parallel to the output shaft of the needle bar case motor 45. A helical cam 48 is affixed to the rotating shaft 47. One of the eight engaging rollers 42 is always engaged with the helical cam 48. The needle bar case motor 45 transmits a driving force to the rotating shaft 47 via a gear portion 46, thus rotating the helical cam 48 by a specified amount.

An operation by which the needle bar case 21 is moved by the needle bar case moving mechanism 40 will be explained. With every revolution of the helical cam 48, the needle bar case moving mechanism 40 is able to move the needle bar case 21 to one of the left and the right by a distance X. Specifically, an example will be explained of a case in which the needle bar case 21 is moved to the left by the distance X from the state that is shown in FIG. 5. In the state that is shown in FIG. 5, the frame 24 within the needle bar case 21 is located at the right end of the range through which the frame 24 can move. In this state, the needle drop position that is located at the center of the right-to-left direction in the multi-needle sewing machine 1 is directly below the number six needle bar 31, which is the farthest to the left of the six needle bars 31. By rotating the drive shaft (not shown in the drawings) in this state, the multi-needle sewing machine 1 is able to move up and down only the number six needle bar 31 of the six needle bars 31, and is able to perform sewing using the thread that is supplied to the eye of the needle 35 in the number six needle bar 31.

Starting from the state that is shown in FIG. 5, the helical cam 48 is rotated counterclockwise, as viewed from the right side. When this happens, the engaging roller 42 that is the farthest to the left slides in relation to the helical cam 48, and the frame 24 starts moving to the left. Next, the engagement with the helical cam 48 of the engaging roller 42 that is the farthest to the left is released, and the engaging roller 42 that is the second from the left engages the helical cam 48. When the helical cam 48 completes one revolution, the needle bar 31 (the number five needle bar 31) that is the second from the left is accurately positioned straight above the needle drop position. In other words, the frame 24 moves to the left by the distance X from the state that is shown in FIG. 5. Further, if the helical cam 48 completes one clockwise revolution as seen from the right side, the frame 24 moves to the right by the distance X. Thus, using the needle bar case moving mechanism 40, it is possible to move the frame 24 to one of the left and the right by the distance X for each complete revolution of the helical cam 48. This makes it possible to switch the needle bar 31 that is used for sewing to the adjacent needle bar 31 accurately and easily. If the helical cam 48 completes five revolutions counterclockwise from the state that is shown in FIG. 5, the number one needle bar 31, which is the needle bar 31 that is the farthest to the right, moves accurately to a position that is straight above the needle drop position.

Furthermore, the image sensor 52 is held at a position that is the distance 2× from the number one needle bar 31, which is the needle bar 31 that is the farthest to the right (refer to FIG. 2). Therefore, the helical cam 48 completes seven revolutions counterclockwise from the state that is shown in FIG. 5, as seen from the right side, so that the image sensor 52 may be moved accurately to a position that is straight above the needle drop position (refer to FIG. 6).

The position of the image sensor 52 that is shown in FIG. 6 serves as an image capture position at which an image is captured of the area including the needle drop position. The image that is captured by the image sensor 52 is displayed on the liquid crystal display 7. Because the image capture position of the image sensor 52 in the present embodiment is straight above the needle drop position, there is almost no distortion in the captured image, compared to a case in which the image is captured from a position that is obliquely overhead in relation to the needle drop position. Accordingly, processing to correct the captured image may not be required. The user may therefore easily recognize the needle drop position based on the captured image that is displayed on the liquid crystal display 7. Moreover, there may be little distortion of the captured image in a case where a specific position is determined using the captured image, such as a case where the captured image is processed and a sewing position is determined, or the like. There may therefore be little distortion of coordinates within the captured image. Accordingly, it is possible to determine a specific position with good precision. Unlike a known sewing machine in which the position of the image sensor 52 is fixed, in the multi-needle sewing machine 1 in the present embodiment, it is possible to withdraw the image sensor 52 from the position that is straight above the needle drop position while the sewing is being performed. Accordingly, there is no concern that the image sensor 52 will become an obstacle in the paths of the upper threads 15. There is also no concern that the positions in which other members are disposed will be restricted.

The image sensor holding mechanism 51 will be explained with reference to FIGS. 7 to 11. In the explanation that follows, in FIGS. 7 and 9, the lower left side, the upper right side, the upper left side, and the lower right side of the page respectively indicate the front side, the rear side, the left side, and the right side of the multi-needle sewing machine 1.

Figure 7:
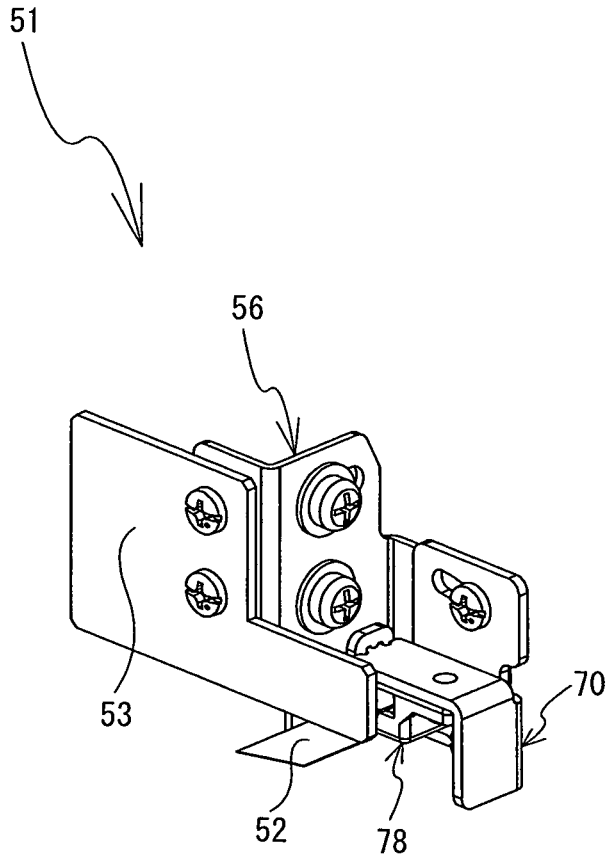
FIG. 7 is an oblique view of an image sensor holding mechanism.
Figure 8:
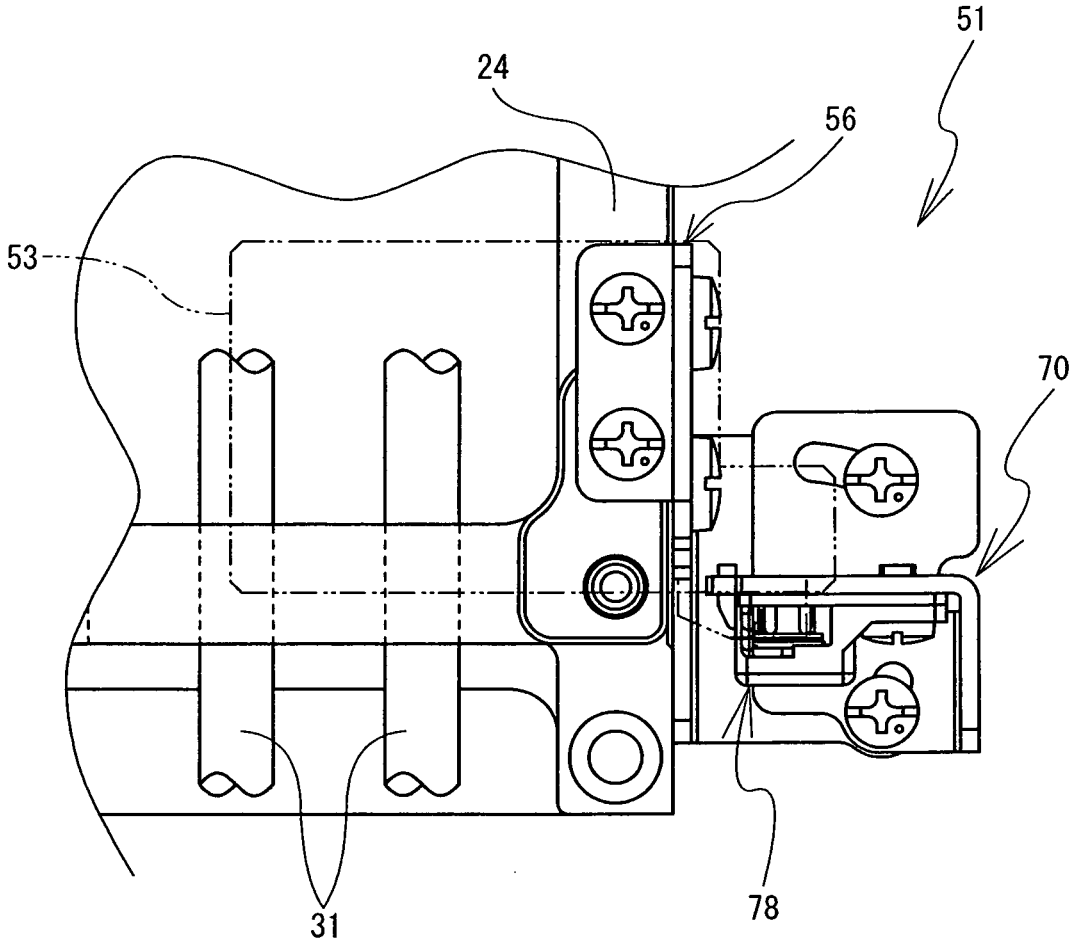
FIG. 8 is an enlarged front view of the image sensor holding mechanism, which is held in the frame.

As shown in FIG. 7, the image sensor holding mechanism 51 holds the image sensor 52 and a junction plate 53. The image sensor 52 is a known complementary metal oxide semiconductor (CMOS) image sensor, and the image sensor 52 captures an image. The junction plate 53 is provided with a connector that connects electrically to the image sensor 52 and a connector that connects electrically to a control portion 100 (refer to FIG. 4) of the multi-needle sewing machine 1, although the connectors are not shown in the drawings. The image sensor holding mechanism 51 is mainly provided with a front-rear adjustment platform 56, a right-left adjustment platform 70, and a sensor holder 78. The junction plate 53 is fixed to the front-rear adjustment platform 56. The front-rear adjustment platform 56 holds the right-left adjustment platform 70 in a state in which the right-left adjustment platform 70 may be tilted to the left and to the right. The sensor holder 78 is fixed to the right-left adjustment platform 70. The image sensor 52 is fixed to the sensor holder 78. As shown in FIG. 8, the frame 24 in the needle bar case 21 holds the front-rear adjustment platform 56, which holds the right-left adjustment platform 70 and the junction plate 53. In FIG. 8, the junction plate 53 is indicated by a broken line to make the explanation easier.

Figure 9:
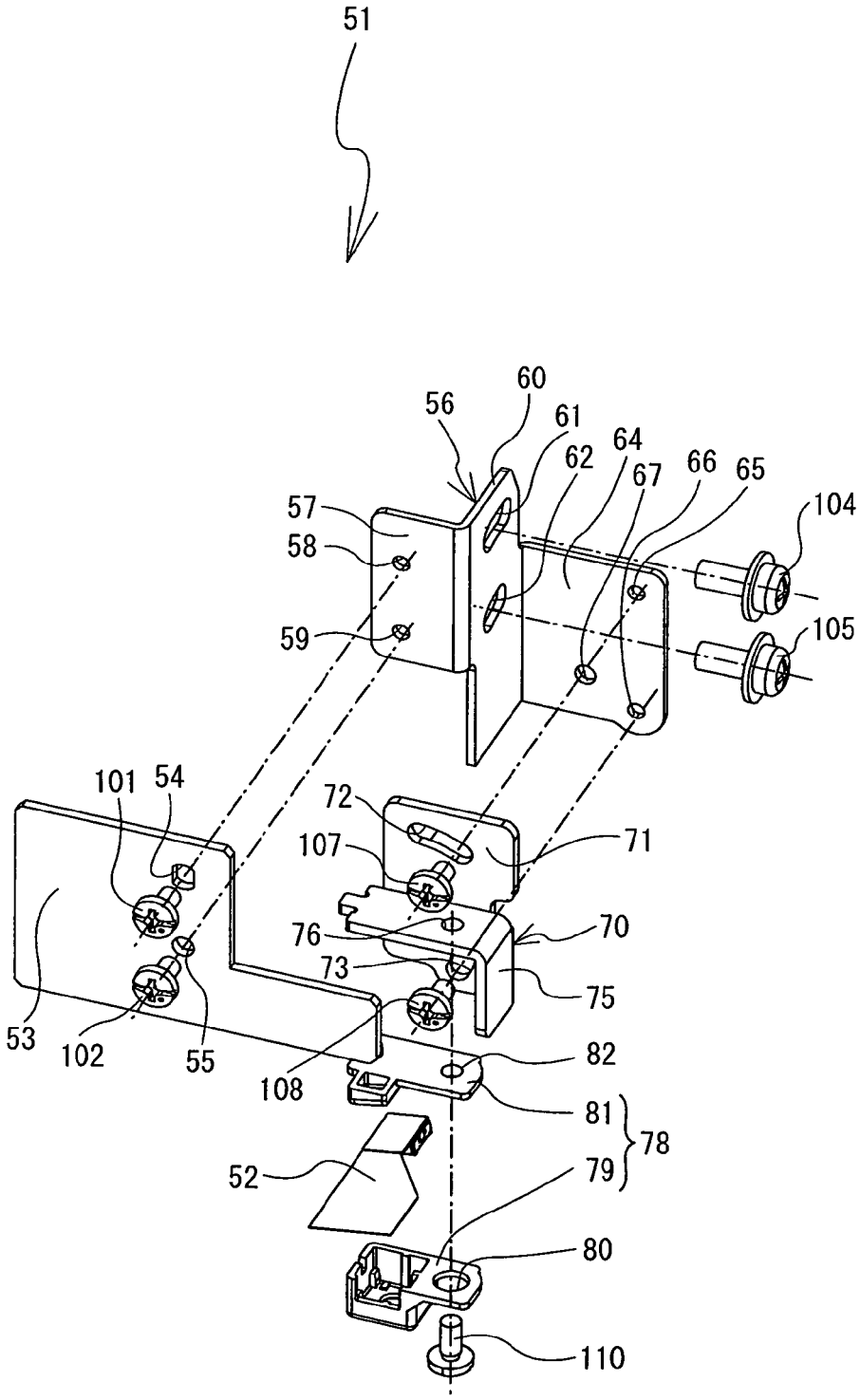
FIG. 9 is an oblique exploded view of the image sensor holding mechanism.

The front-rear adjustment platform 56 will be explained. As shown in FIG. 9, the front-rear adjustment platform 56 includes a plate connecting portion 57, a frame connecting portion 60, and a platform connecting portion 64, all of which are formed into rectangular plate shapes.

Two threaded holes 58 and 59 are provided in the plate connecting portion 57. A threaded fastener 101 is passed through a hole 54 in the junction plate 53 and fastened into the threaded hole 58. A threaded fastener 102 is passed through a hole 55 in the junction plate 53 and fastened into the threaded hole 59. The junction plate 53 is thus fixed to the plate connecting portion 57.

Figure 10:
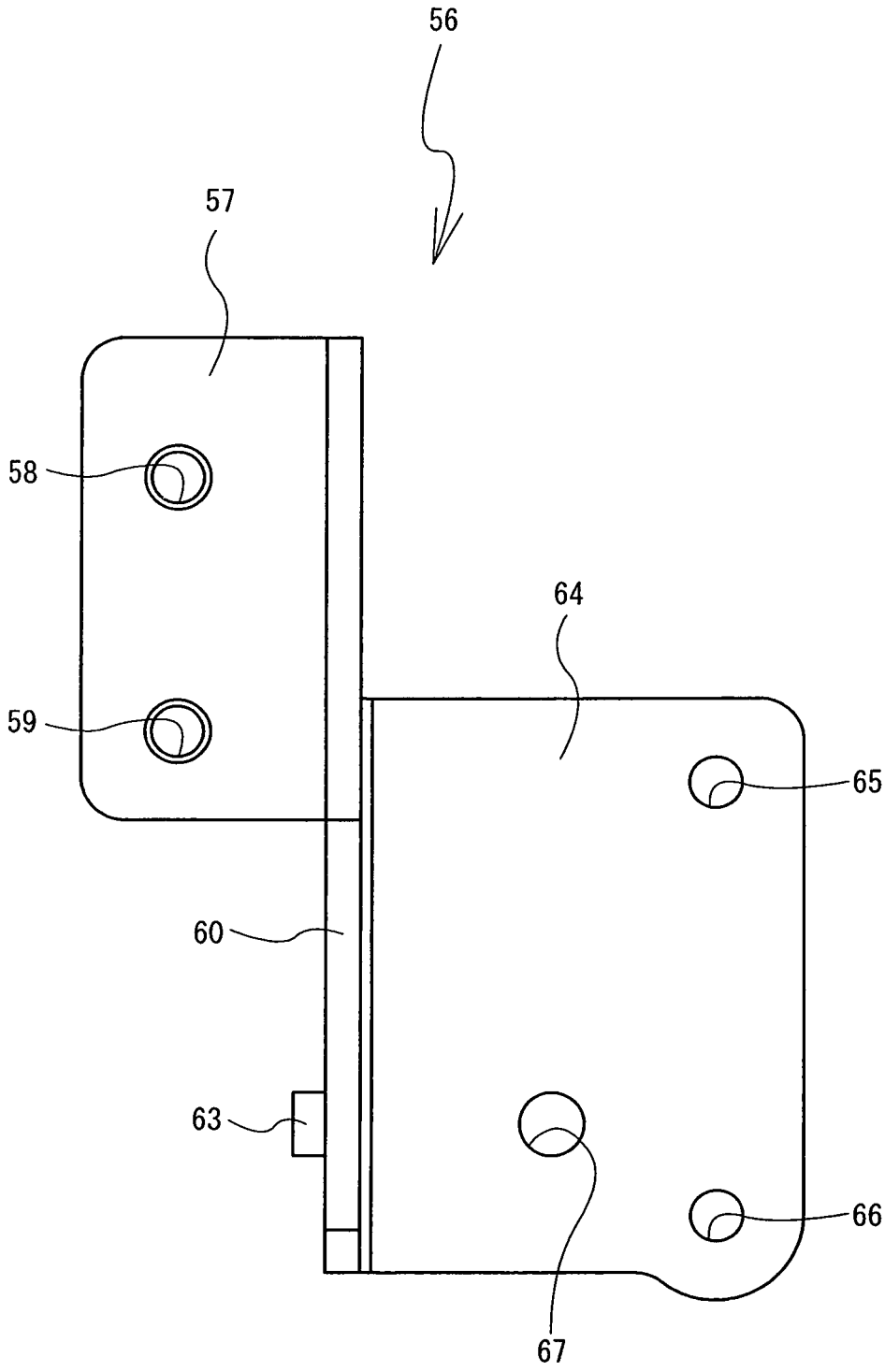
FIG. 10 is a front view of a front-rear adjustment platform.

The frame connecting portion 60 extends perpendicularly to the rear from the right edge of the plate connecting portion 57. The length of the frame connecting portion 60 in the up-down direction is greater than the length of the plate connecting portion 57 in the up-down direction. The position of the upper edge of the frame connecting portion 60 is aligned with the position of the upper edge of the plate connecting portion 57. The frame connecting portion 60 is provided with circular arc-shaped long holes 61 and 62. As shown in FIG. 10, a cylindrical front-rear tilting shaft 63 projects from the lower portion of the left side face of the frame connecting portion 60. The front-rear tilting shaft 63 is inserted into a shaft hole (not shown in the drawings) that is formed in the frame 24 (refer to FIG. 8). The long holes 61 and 62 that are shown in FIG. 9 are curved such that the long holes 61 and 62 respectively draw circular arcs that are centered around the front-rear tilting shaft 63. Threaded fasteners 104 and 105 are passed through the long holes 61 and 62 and fastened into threaded holes (not shown in the drawings) in the frame 24, thus fixing the frame connecting portion 60 to the frame 24.

As shown in FIG. 9, the platform connecting portion 64 extends perpendicularly to the right from the lower portion of the rear edge of the frame connecting portion 60. The position of the bottom edge of the platform connecting portion 64 is aligned with the position of the bottom edge of the frame connecting portion 60. Two threaded holes 65 and 66 and a shaft hole 67 are provided in the platform connecting portion 64. The threaded holes 65 and 66 are used when the right-left adjustment platform 70 is fastened. A right-left tilting shaft 74 that will be described later is inserted into the shaft hole 67. The position at which the shaft hole 67 is provided and the position of the front-rear tilting shaft 63 (refer to FIG. 10) in the frame connecting portion 60 are at the same height.

The right-left adjustment platform 70 will be explained. As shown in FIG. 9, the right-left adjustment platform 70 includes a base portion 71 and a holder fixing portion 75. The base portion 71 is a plate-shaped member that is roughly rectangular when viewed from the front. The holder fixing portion 75 is a plate-shaped member that is bent into a reverse L shape as viewed from the front.

Figure 11:
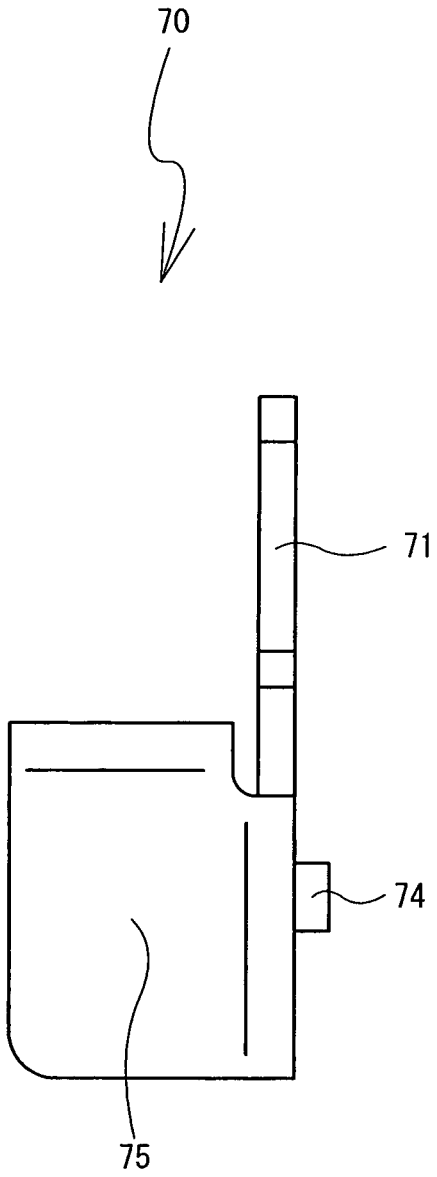
FIG. 11 is a right side view of the right-left adjustment platform.

Arc-shaped long holes 72 and 73 are provided in the base portion 71. As shown in FIG. 11, the cylindrical right-left tilting shaft 74 projects from the left side of the lower portion of the rear side of the base portion 71. The right-left tilting shaft 74 is inserted into the shaft hole 67 that is provided on the platform connecting portion 64 of the front-rear adjustment platform 56. The long holes 72 and 73 are curved such that the long holes 72 and 73 draw circular arcs that are centered around the right-left tilting shaft 74. As shown in FIG. 9, threaded fasteners 107 and 108 are passed through the long holes 72 and 73 and fastened into the threaded holes 65 and 66 in the platform connecting portion 64, thus fixing the base portion 71 to the front-rear adjustment platform 56.

As shown in FIG. 9, the holder fixing portion 75 extends perpendicularly toward the front side from a central portion, in the up-down direction, of the front of the base portion 71. A threaded hole 76 is provided in the holder fixing portion 75 for securing the sensor holder 78. The holder fixing portion 75 is bent downward from the right side of the threaded hole 76. The right side of the sensor holder 78 is therefore covered, and the image sensor 52 may be protected.

The sensor holder 78 will be explained. The sensor holder 78 includes a sensor support portion 79 and a sensor presser 81. A recessed portion is provided in the left half of the sensor support portion 79. The image sensor 52 is supported by the recessed portion. A hole 80 through which a threaded fastener passes is provided in the right half of the sensor support portion 79. The sensor presser 81 presses the image sensor 52, which is supported by the sensor support portion 79, from above the image sensor 52, thus fixing the image sensor 52 in place. A hole 82 is provided in the right half of the sensor presser 81. A threaded fastener 110 passes through the hole 80 in the sensor support portion 79 and the hole 82 in the sensor presser 81 and is fastened into the threaded hole 76 in the holder fixing portion 75 of the right-left adjustment platform 70. The sensor holder 78 thus fixes the image sensor 52 in place and is fixed to the right-left adjustment platform 70.

A method for adjusting the mounting angle of the image sensor 52 using the image sensor holding mechanism 51 will be explained with reference to FIGS. 12 to 15.

Figure 12:
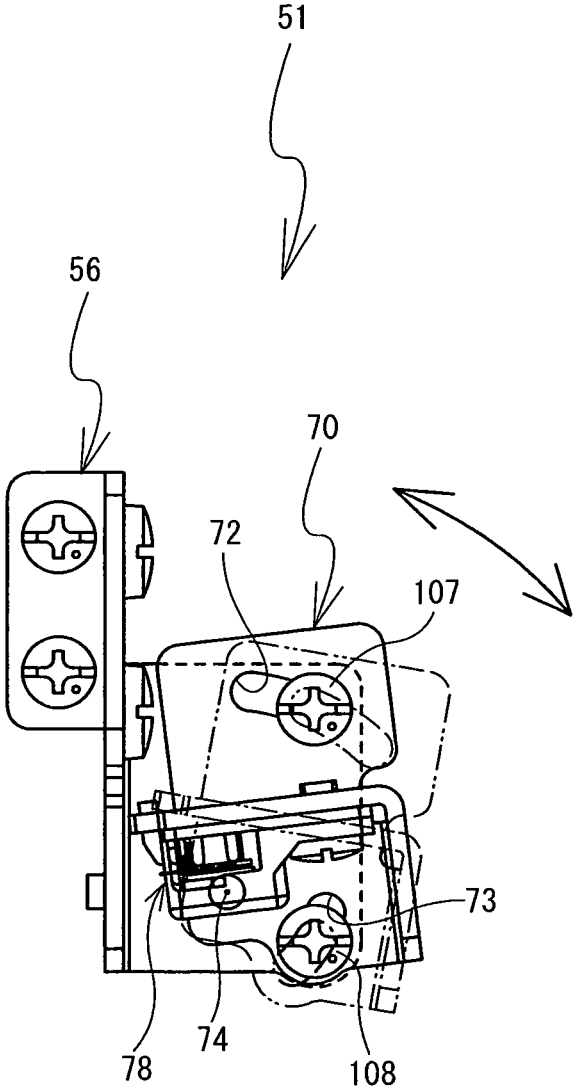
FIG. 12 is a front view of the image sensor holding mechanism.

An adjustment of the right-left mounting angle of the image sensor 52 will be explained. As shown in FIG. 12, the right-left tilting shaft 74, which is a shaft that extends in the front-to-rear direction, is provided in the right-left adjustment platform 70. The left-right tilting shaft 74 is rotatably inserted into the shaft hole 67 of the front-rear adjustment platform 56 (refer to FIG. 9). By loosening the threaded fasteners 107 and 108, the user may tilt the right-left adjustment platform 70 using the left-right tilting shaft 74 as an axis. When the left-right adjustment platform 70 is being tilted, the edges of the long holes 72 and 73 slide in relation to the loosened threaded fasteners 107 and 108. The long holes 72 and 73 have shapes of circular arcs that are centered around the right-left tilting shaft 74. Thus, the operation of tilting the right-left adjustment platform 70 may be guided, and the adjustment of the right-left mounting angle may be performed smoothly.

As shown in FIG. 12, the sensor holder 78 that holds the image sensor 52 is positioned on the axis line of the right-left tilting shaft 74. Therefore, even if the right-left adjustment platform 70 is tilted in the right-left direction, the position of the sensor holder 78 may not change. Only the right-left mounting angle of the image sensor 52 may change. There may be only a slight change in the tilt angle of the sensor holder 78 in relation to the distance that the upper portion of the right-left adjustment platform 70 moves. The user may therefore easily perform the fine adjustment of the right-left mounting angle.

Figure 13:
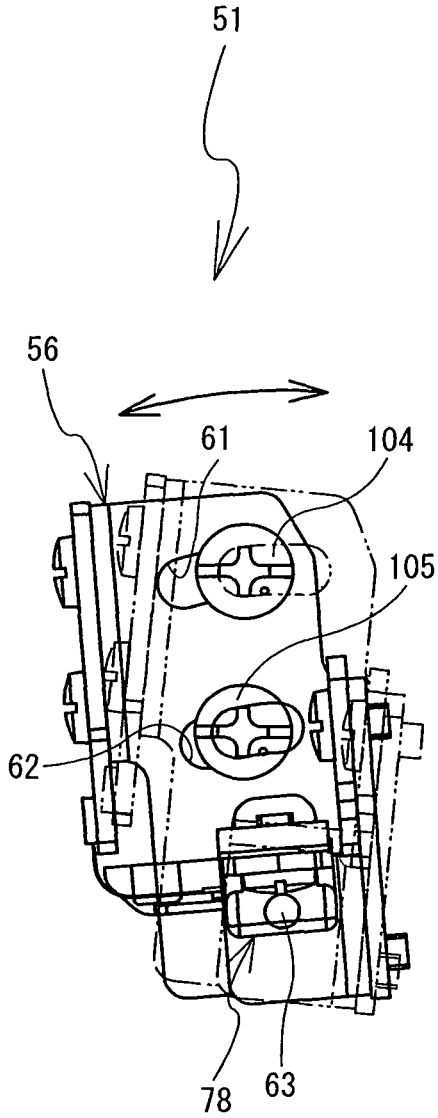
FIG. 13 is a right side view of the image sensor holding mechanism.

An adjustment of the front-rear mounting angle of the image sensor 52 will be explained. As shown in FIG. 13, the front-rear tilting shaft 63, which extends in the right-to-left direction, is provided in the front-rear adjustment platform 56. The front-rear tilting shaft 63 is rotatably inserted into the shaft hole (not shown in the drawings) that is formed in the frame 24 in the needle bar case 21. By loosening the threaded fasteners 104 and 105, the user may tilt the front-rear adjustment platform 56 using the front-rear tilting shaft 63 as an axis. When the front-rear adjustment platform 56 is being tilted, the long holes 61 and 62 slide in relation to the loosened threaded fasteners 104 and 105. The long holes 61 and 62 have shapes of circular arcs that are centered around the front-rear tilting shaft 63. Thus, the operation of tilting the front-rear adjustment platform 56 may be guided, and the adjustment of the front-rear mounting angle may be performed smoothly.

As shown in FIG. 13, the sensor holder 78 that holds the image sensor 52 is positioned on the axis line of the front-rear tilting shaft 63. Therefore, in the same manner as in the case where the right-left adjustment platform 70 is tilted to one of the left and the right, the position of the sensor holder 78 may not change, even if the front-rear adjustment platform 56 is tilted in the front-rear direction. Only the front-rear mounting angle of the image sensor 52 may change. There may be only a slight change in the tilt angle of the sensor holder 78 in relation to the distance that the upper portion of the front-rear adjustment platform 56 moves. The user may therefore easily perform the fine adjustment of the front-rear mounting angle.

Figure 14:
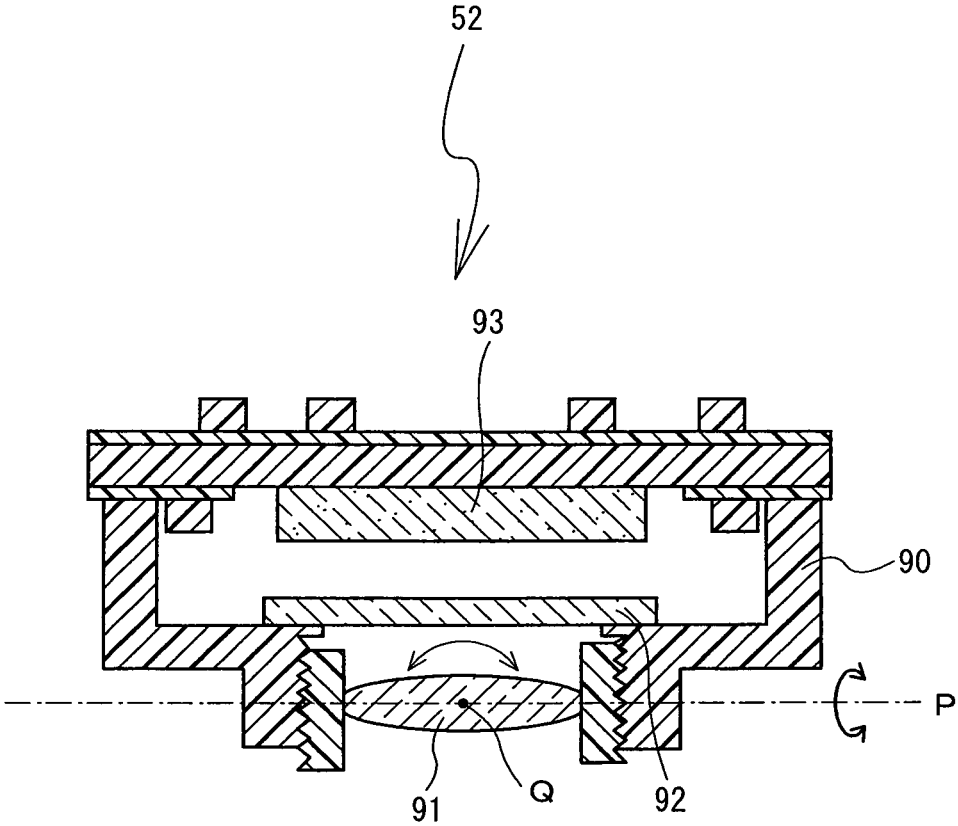
FIG. 14 is a sectional view of an image sensor from the front.

Positional relationships among an axis line P of the front-rear tilting shaft 63, an axis line Q of the left-right tilting shaft 74, and the image sensor 52 will be explained in detail. As shown in FIG. 14, the image sensor 52 is provided with an opening in the bottom of a substantially cube-shaped housing 90, and a lens 91 is disposed in the opening. An ultraviolet light shielding portion 92 is provided above the lens 91. A known CMOS 93 is disposed on the upper side in the housing 90. The horizontal axis line P of the front-rear tilting shaft 63 passes through the lens 91. In the same manner, the horizontal axis line Q of the right-left tilting shaft 74 also passes through the lens 91. Therefore, even if the image sensor holding mechanism 51 is tilted to one of the front, the rear, the left, and the right, only the angle of the lens 91 may change, and the position of the lens 91 may not change. Accordingly, even in a case where the mounting angle of the image sensor 52 has been changed, it is possible to accurately position the image sensor 52 straight above the needle drop position by moving the image sensor 52 to the image capture position (the position that is shown in FIG. 6). Compared to the distance that the upper edge of the image sensor holding mechanism 51 is moved, there may be only a slight change in the angle of the lens 91. The user may therefore easily perform the fine adjustment of the mounting angle.

Figure 15:
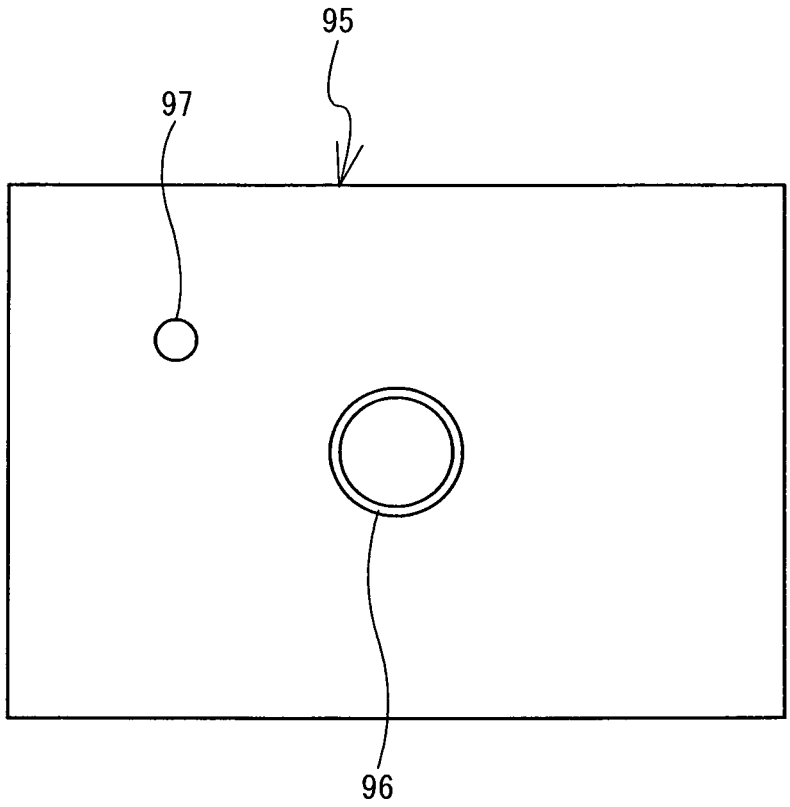
FIG. 15 is a figure that shows an example of an adjusted image that is displayed on a liquid crystal display.

An adjustment screen 95 will be explained. When the user operates the touch panel 9 and makes a setting that adjusts the mounting angle of the image sensor 52, the CPU 141 (refer to FIG. 4) of the multi-needle sewing machine 1 causes the adjustment screen 95, which is shown in FIG. 15, to be displayed on the liquid crystal display 7. The image that has been captured by the image sensor 52 is displayed on the adjustment screen 95. Further, a circular center mark 96 is displayed in the center of the adjustment screen 95. Ordinarily, in a case where the image sensor 52 is at the image capture position, the image sensor 52 captures an image of the needle plate 16 on the cylinder bed 10 (refer to FIG. 1). The needle hole 97 is provided in the needle plate 16, and the needle hole 97 serves as the needle drop position. Therefore, while looking at the adjustment screen 95, the user may adjust the mounting angle of the image sensor 52 such that the needle hole 97 in the captured image may be positioned within the center mark 96. Thus the user may easily use the image sensor 52 to capture an image with little distortion that has the needle drop position at the center of the image.

As explained previously, in the multi-needle sewing machine 1 in the present embodiment, the image sensor 52 that captures the image is lined up with the plurality of the needle bars 31 in the needle bar case 21. The needle bar case moving mechanism 40 may move the needle bar case 21 such that the image sensor 52 may be positioned straight above the needle drop position. In other words, in addition to moving any one of the six needle bars 31 to a position that is straight above the needle drop position, the needle bar case moving mechanism 40 may move the image sensor 52 to the image capture position, which is straight above the needle drop position. Therefore, it is not necessary to provide a separate mechanism for moving the image sensor 52. Furthermore, an image of the needle drop position may be captured from straight above the needle drop position without interfering with the needle bars 31 and the like. By capturing an image of the needle drop position from directly overhead, the multi-needle sewing machine 1 is able to capture an image that is easy to view and has no distortion. Because there is no distortion in the image, processing such as image processing, position determination processing, and the like may become easy.

In the multi-needle sewing machine 1, the image sensor 52 is lined up to the outside of the six needle bars 31 that are lined up. Therefore, the image sensor 52 may not interfere with structural parts such as the needle bars 31 and the like. It is also possible for the needle bar case moving mechanism 40 to be made more compact. The distance between the image sensor 52 and the number one needle bar 31 that is adjacent to the image sensor 52 is an integral multiple of the interval X between the needle bars 31. Therefore, by moving the needle bar case 21, the needle bar case moving mechanism 40 may move one of the image sensor 52 and the six needle bars 31 to a position that is straight above the needle drop position, with the interval X between the needle bars 31 serving as a single unit of movement, that is, with one complete revolution of the helical cam 48 serving as a single unit of movement. It is not necessary for the method of moving the needle bar case 21 to be different in a case where the image sensor 52 is moved to the image capture position and in a case where one of the six needle bars 31 is moved to the sewing position. Accordingly, it is possible for the image sensor 52 to be moved easily to the image capture position by a simple configuration. It is also possible for the image sensor 52 to be moved accurately to a position that is straight above the needle drop position.

In addition, the user may adjust the mounting angle of the image sensor 52 by tilting the image sensor holding mechanism 51 that holds the image sensor 52 to the front, the rear, the left, and the right. The central axes of the tilting of the image sensor holding mechanism 51 pass through the lens 91 of the image sensor 52. Therefore, the position of the lens 91 may not change, even in a case where the mounting angle is adjusted. Accordingly, the image sensor 52 may not shift away from the position that is straight above the needle drop position. Compared to the distance that the upper edge of the image sensor holding mechanism 51 may be moved, there is only a slight change in the angle of the lens 91. The user may therefore easily perform the fine adjustment of the mounting angle.

The configuration and the processing that have been explained in the embodiment that is described above are only examples, and various types of modifications may be made. The position in which the image sensor 52 is disposed may be changed as desired. For example, the image sensor 52 may be disposed on the left side of the needle bar case 21 instead of the right side. As described above, it is desirable for the distance between the image sensor 52 and the needle bar 31 that is adjacent to the image sensor 52 to be an integral multiple of the interval X between the needle bars 31. However, it is acceptable for the distance to the adjacent needle bar 31 not to be an integral multiple of the interval X.

The image sensor 52 may also be disposed in a position that is between any two of the needle bars 31. For example, within the frame 24 of the needle bar case 21 that is shown in FIG. 2, the image sensor 52 may be disposed between the number three needle bar 31, which is the third needle bar 31 from the right, and the number four needle bar 31, which is the fourth needle bar 31 from the right. In this case, the distance between the image sensor 52 and the needle bar 31 in the position that is farthest from the image sensor 52 (the needle bar 31 that is the farthest to the outside) may be shortened. Accordingly, the distance that the needle bar case 21 is moved may be shortened.

It is not necessary for the plurality of the needle bars 31 and the image sensor 52 to be lined up in a straight line. The needle bar case moving mechanism 40 in the embodiment that is described above may reciprocally move the needle bar case 21 to the right and the left in a straight line. Accordingly, in the embodiment that is described above, lining up the plurality of the needle bars 31 and the image sensor 52 in a straight line makes it possible for the image sensor 52 to be moved easily to a position that is straight above the needle drop position. However, if the multi-needle sewing machine 1 is configured such that the path that the needle bar case 21 travels forms a circular arc in a plan view, for example, the needle bars 31 and the image sensor 52 may be lined up in a circular arc, such that the needle bars 31 and the image sensor 52 travel on a path that forms a circular arc.

It is desirable for the central axes of the tilting of the image sensor holding mechanism 51 to pass through the lens 91 of the image sensor 52, as in the embodiment that is described above. However, the central axes of the tilting may deviate slightly from the lens 91. For example, if the central axes of the tilting pass through the housing 90 of the image sensor 52 (refer to FIG. 14), the lens 91 may move only slightly when the image sensor holding mechanism 51 is tilted. Therefore, no problems would occur in capturing an image. In other words, as long as the image sensor holding mechanism 51 is configured such that the central axes of the tilting pass through the vicinity of the lens 91, a good-quality captured image may be obtained.

Other configuring elements may also be modified as desired. For example, the number of the needle bars 31 is not limited to six. The image sensor 52 may be an image capture element other than a CMOS image sensor, such as a CCD camera or the like. It is acceptable for the needle bar case moving mechanism 40 not to be driven by the needle bar case motor 45. A configuration in which the user moves the needle bar case moving mechanism 40 manually may also be used. The structure of the image sensor holding mechanism 51 may be modified. The center mark 96 of the adjustment screen 95 (refer to FIG. 15) may be modified. It is acceptable for the center mark 96 not to be circular. The center mark 96 may be a rectangle, a cross, or the like.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A multi-needle sewing machine, comprising:

a plurality of needle bars, each needle bar being configured to receive a needle at a bottom end;

a needle bar case in which the plurality of needle bars are disposed in a line and that supports the plurality of the needle bars movably in an up-and-down direction;

a needle bar case moving device that, by moving the needle bar case, moves one of the plurality of the needle bars to an image capture position, the image capture position being a position that is located directly above a needle drop position that is a sewing position; and an image capture device that is provided in a position that is lined up with the plurality of the needle bars in the needle bar case, that is positioned in the image capture position by the needle bar case moving device's moving of the needle bar case, and that captures an image, wherein:

the image capture device is provided in a position that is to an outside of a group of the plurality of the needle bars that are disposed in the line in the needle bar case, distances between adjacent needle bars of the plurality of the needle bars that are supported by the needle bar case are equal, and a distance between the image capture device and one of the needle bars that is adjacent to the image capture device is an integral multiple of one of the distances between the adjacent needle bars.

2. The multi-needle sewing machine according to claim 1, wherein:

the image capture device includes an image capture element and a lens, and the multi-needle sewing machine further comprises a supporting member that supports the image capture device tiltably around a horizontal axis line that passes through the lens.

3. The multi-needle sewing machine according to claim 1, further comprising:

a display device that displays an image; and a display control device that causes the image that is captured by the image capture device to be displayed on the display device, wherein the display control device causes a mark that indicates a center of the image to be displayed on the display device.

* * * * *